United States Patent [19]

Marusiak, Jr.

[11] 4,116,507

[45] Sep. 26, 1978

[54] RADIATOR CONCEALING ARTICLE OF FURNITURE

[75] Inventor: Frank Marusiak, Jr., Newark, N.J.

[73] Assignee: The Raymond Lee Organization, Inc., New York, N.Y. ; a part interest

[21] Appl. No.: 849,006

[22] Filed: Nov. 7, 1977

[51] Int. Cl.[2] ..... F24H 9/04; A47B 81/00

[52] U.S. Cl. ..... 312/210; 312/204; 237/79

[58] Field of Search ..... 312/204, 210, 237, 233; 165/148, 149; 237/79

[56] References Cited

U.S. PATENT DOCUMENTS

| | | | |
|---|---|---|---|
| 499,686 | 6/1893 | Welker | 237/79 |
| 1,624,042 | 4/1927 | Duggins | 237/79 |
| 1,850,605 | 3/1932 | Schwartz | 237/79 |
| 1,875,918 | 9/1932 | Ewald | 237/79 |
| 1,880,281 | 10/1932 | Reynolds | 237/79 |
| 1,894,362 | 1/1933 | Stine | 237/79 |
| 1,908,790 | 5/1933 | Robertson et al. | 237/79 |
| 2,496,221 | 1/1950 | Koch | 312/204 |
| 2,865,569 | 12/1958 | Levenberg | 312/210 |

*Primary Examiner*—Mervin Stein
*Assistant Examiner*—Victor N. Sakran
*Attorney, Agent, or Firm*—Daniel Jay Tick

[57] ABSTRACT

A bookshelf unit has a pair of parallel sides spaced from each other, a distance greater than the length of a heating system radiator. The sides have a width greater than the width of the radiator. A plurality of book shelves extend between, and are supported by, the sides in spaced parallel relation. A cover panel removably mounted in the bookshelf unit covers the area between the sides and the lowermost bookshelf and thereby covers the radiator and permits a free flow of air while obstructing a view of the radiator.

1 Claim, 3 Drawing Figures

RADIATOR CONCEALING ARTICLE OF FURNITURE

BACKGROUND OF THE INVENTION

The present invention relates to a radiator concealing article of furniture. More particularly, the invention relates to a radiator concealing article of furniture for concealing a heating system radiator having a predetermined length, width and height.

Objects of the invention are to provide a radiator concealing article of furniture of simple structure, which is inexpensive in manufacture, placed over a heating system radiator with facility and convenience, and functions efficiently, effectively and reliably as a bookshelf and storage unit while simultaneously concealing the radiator from view, while permitting a free flow of air to, from and around the radiator.

BRIEF DESCRIPTION OF THE DRAWINGS

In order that the invention may be readily carried into effect, it will now be described with reference to the accompanying drawings, wherein.

DETAILED DESCRIPTION OF THE INVENTION

Figure 1:
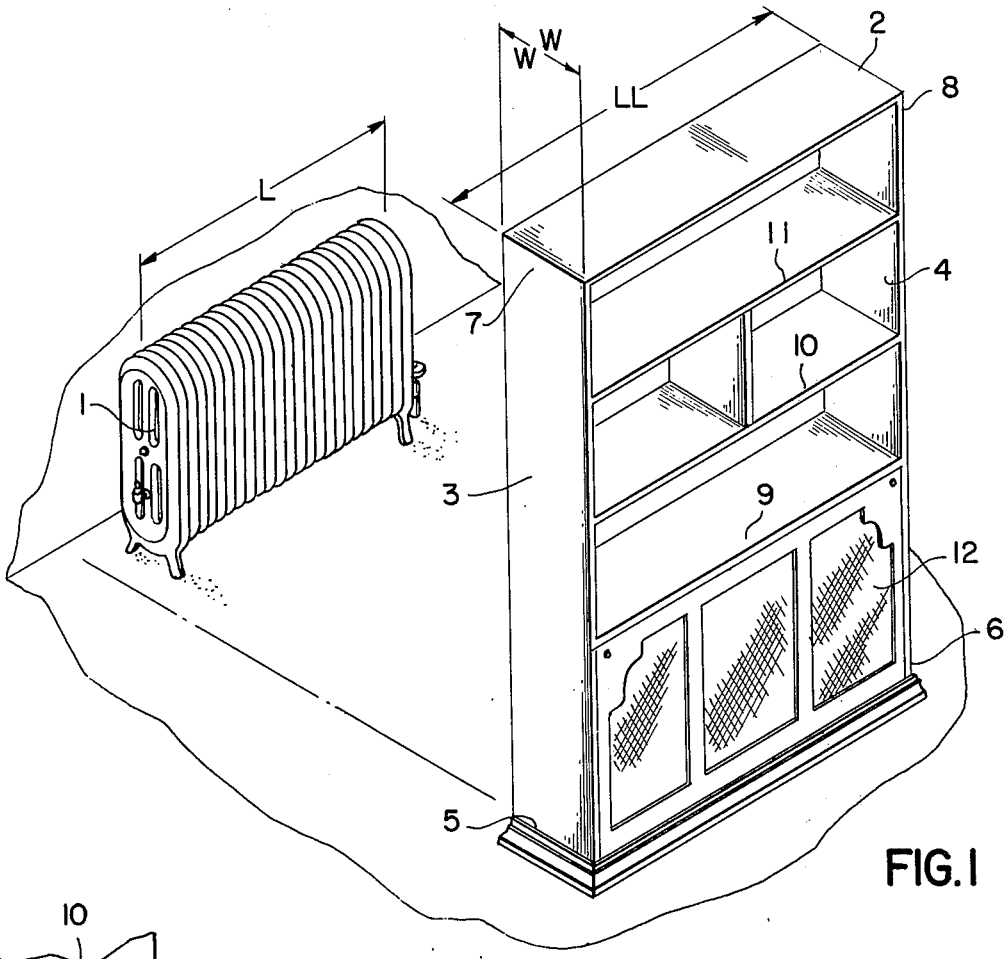
FIG. 1 is a perspective view of an embodiment of the radiator concealing article of furniture in position and being moved over a heating system radiator.
Figure 2:
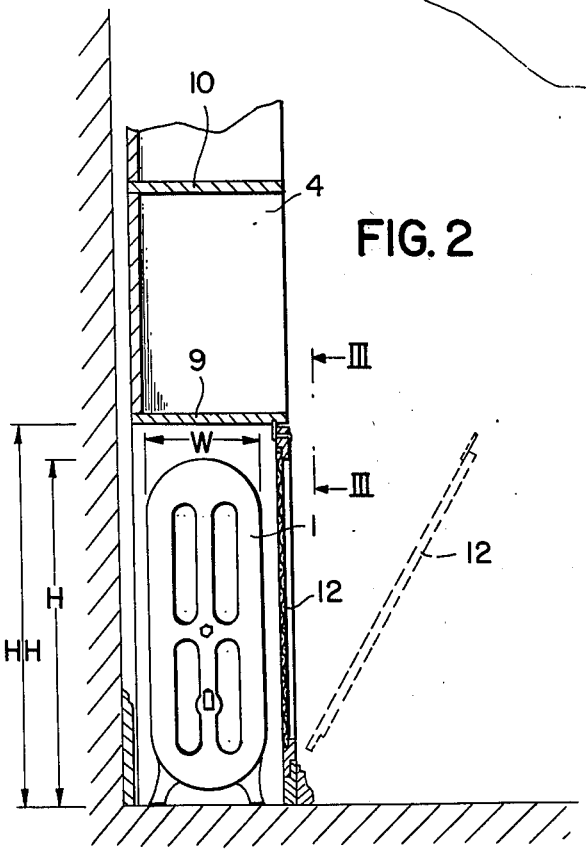
FIG. 2 is a cross-sectional view, on an enlarged scale, of part of the article of furniture of FIG. 1 positioned over a heating system radiator.

The radiator concealing article of furniture of the invention conceals a heating system radiator 1 having a predetermined length L (FIG. 1), a predetermined width W (FIG. 2) and a predetermined height H (FIG. 2). The article of furniture of the invention comprises a bookshelf unit 2 (FIG. 1) having a pair of parallel sides 3 and 4 spaced from each other a distance LL greater than the length L of the radiator 1 (FIG. 1).

The sides 3 and 4 of the bookshelf unit 2 are of the same dimensions, and each has a bottom, a top and a predetermined width WW (FIG. 1) greater than the width W of the radiator 1. Thus, as shown in FIG. 1, the sides 3 and 4 have bottoms 5 and 6, respectively, and tops 7 and 8, respectively.

A plurality of bookshelves 9, 10 and 11 (FIGS. 1 and 2) extend between, and are supported by, the sides 3 and 4 in spaced parallel relation substantially perpendicular to said sides, as shown in FIG. 1. The lowermost bookshelf 9 is spaced a greater distance HH from the bottoms 5 and 6 of the sides 3 and 4, respectively, than the height H of the radiator 1, as shown in FIG. 2. Thus, the radiator 1 is accommodated with clearance in the bookshelf unit 2 between the sides 3 and 4 and the lowermost bookshelf 9.

A cover panel 12 is removably mounted in the bookshelf unit 2 in perpendicular relation to the sides 3 and 4 and the bookshelves 9, 10 and 11. The cover panel 12 covers the area between the sides 3 and 4 and the lowermost bookshelf 9, as shown in FIG. 1, and thereby covers the radiator 1. The cover panel 12 has screening, latticework, mesh, or the like, therein to permit a free flow of air therethrough while obstructing a view of the radiator 1.

Figure 3:
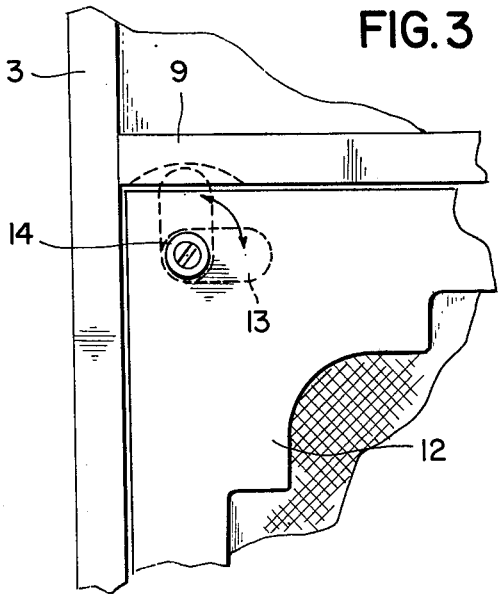
FIG. 3 is a view, on an enlarged scale, taken along the lines III—III, of FIG. 2, of part of the cover panel of the article of furniture of the invention, illustrating an embodiment of a securing member therefor.

The cover panel 12 may be secured in position by any suitable securing device such as, for example, a dog member 13 pivotally mounted thereon in the area of the upper border thereof in a manner whereby, as shown in FIG. 3, when said dog member is positioned substantially vertically, it extends beyond the cover panel and behind a ledge provided for the purpose, beneath the bookshelf 9, thereby clamping the cover member to said ledge. When the dog member 13 is positioned substantially horizontally, it is free from the restraining ledge thereby freeing the cover panel 12 for removal from the bookshelf unit 2. The dog member 13 is manually rotatable or pivotable about its pivot pin 14 (FIG. 3) by any suitable tool such as, for example, a screwdriver.

While the invention has been described by means of a specific example and in a specific embodiment, I do not wish to be limited thereto, for obvious modifications will occur to those skilled in the art without departing from the spirit and scope of the invention.

I claim:

1. A radiator concealing article of furniture for concealing a heating system radiator having a predetermined length, width and height, said article of furniture comprising a bookshelf unit having a pair of parallel sides spaced from each other a distance greater than the length of the radiator, the sides being of the same dimensions and each having a bottom, a top and a predetermined width greater than the width of the radiator, a plurality of bookshelves extending between and supported by the sides in spaced parallel relation substantially perpendicular to said sides, the lowermost bookshelf being spaced a greater distance from the bottoms of the sides than the height of the radiator whereby the radiator is accommodated with clearance in the bookshelf unit between the sides and the lowermost bookshelf, a ledge provided in the lowermost bookshelf, a cover panel removably mounted in the bookshelf unit in perpendicular relation to the sides and the bookshelves, said cover panel covering the area between the sides and the lowermost bookshelf and thereby covering the radiator and having screening therein for permitting a free flow of air through said cover panel while obstructing a view of said radiator, and a securing device for clamping said cover panel to said ledge.

* * * * *